US008295720B2

(12) United States Patent
Shiori

(10) Patent No.: US 8,295,720 B2
(45) Date of Patent: Oct. 23, 2012

(54) IMAGE FORMING APPARATUS CAPABLE OF SUPPRESSING TONER AGGREGATION

(75) Inventor: Jun Shiori, Ebina (JP)

(73) Assignee: Ricoh Co., Ltd., Tokyo (JP)

( * ) Notice: Subject to any disclaimer, the term of this patent is extended or adjusted under 35 U.S.C. 154(b) by 184 days.

(21) Appl. No.: 12/843,240

(22) Filed: Jul. 26, 2010

(65) Prior Publication Data

US 2011/0026958 A1 Feb. 3, 2011

(30) Foreign Application Priority Data

Jul. 29, 2009 (JP) ..... 2009-176687

(51) Int. Cl.
*G03G 15/00* (2006.01)

(52) U.S. Cl. ..... 399/43; 399/53; 399/75

(58) Field of Classification Search ..... 399/43, 399/75, 38, 81, 53
See application file for complete search history.

(56) References Cited

U.S. PATENT DOCUMENTS 5,239,345 A * 8/1993 Kikuchi et al. ..... 399/236
6,112,043 A * 8/2000 Sakuraba ..... 399/281
7,546,071 B2 * 6/2009 Inoue et al. ..... 399/43 X
7,593,652 B2 9/2009 Takahashi et al. ..... 399/24
7,676,164 B2 3/2010 Shiori et al. ..... 399/24
7,734,200 B2 6/2010 Sugiyama et al. ..... 399/24
2009/0279910 A1 11/2009 Shiori ..... 399/50

FOREIGN PATENT DOCUMENTS

JP 2001-356589 12/2001
JP 2004-138675 5/2004

* cited by examiner

*Primary Examiner* — Sophia S Chen
(74) *Attorney, Agent, or Firm* — Oblon, Spivak, McClelland, Maier & Neustadt, L.L.P.

(57) ABSTRACT

An image forming apparatus includes a controller that starts a forced drive stop sequence for stopping image formation at least by stopping rotation of a developer carrier in a first direction when a number of printed sheets reach a threshold. The forced drive stop sequence rotates the developer carrier in a second direction for a prescribed time period when the image formation is stopped. The forced drive stop sequence stops the rotation of the developer carrier in the second direction and resumes the image formation after the prescribed time has elapsed.

8 Claims, 6 Drawing Sheets

FIG. 4

| THICKNESS OF SHEET (BASIC WEIGHT) | LINE VELOCITY | N NUMBER OF SHEETS |
|---|---|---|
| ~ 81g/$m^2$ | 230mm/s | 300 SHEETS |
| ~ 169g/$m^2$ | 154mm/s | 500 SHEETS |
| ~ 256g/$m^2$ | 77mm/s | 1000 SHEETS |

IMAGE FORMING APPARATUS CAPABLE OF SUPPRESSING TONER AGGREGATION

CROSS-REFERENCE TO THE RELATED APPLICATIONS

This application claims priority under 35 USC §119 to Japanese Patent Application No. 2009-176687, filed on Jul. 29, 2009, the entire contents of which are hereby incorporated by reference.

BACKGROUND OF THE INVENTION

1. Field of the Invention

The present invention relates to an image forming apparatus, such as a copier, a printer, a facsimile, a plotter, a multifunctional machine including multiple functions of such devices, etc.

2. Discussion of the Background Art

Currently, image forming apparatuses employing an electro-photographic system are widely spreading in various industrial fields. In such image forming apparatuses, ideally image density is stable under all circumstances and printing conditions avoiding occurrence of abnormal images. However, due to various loads on the toner, such problems sometimes occur. As one of them, when continuous printing of images having a low image area rate is executed, the toner itself or developer including the toner continuously receives stirring load due to small replenishment of fresh toner. As a result, the toner aggregates and roughly accumulates at a gap of a developer lifting section with in the developer unit and impedes lifting thereof, so that abnormal images having white lines or bands are created.

To suppress occurrence of the abnormal images and deterioration of images, in one known approach, when a prescribed condition is met and when a developing roller or sleeve of a developer carrier stops rotation in a first direction during a developing process, the developing roller or sleeve is reversely rotated for a prescribed time period in a second direction opposite to the first direction, so that the aggregated toner can be smashed or removed as discussed in Japanese Patent Application Laid Open Nos. 2004-138675 and 2001-356589. As the prescribed condition, the Japanese Patent Application Laid Open No. 2004-138675 uses one of temperature, a number of printed sheets counted after replacement of a cartridge, a printing rate, and a combination of those. A developer carrier employed in the Japanese Patent Application Laid Open No. 2001-356589 is reversely rotated when a prescribed threshold determined in accordance with one of aforementioned conditions is met.

However, when the printing operation continues for a long time without stopping the developer carrier, the reverse rotation cannot be practiced and the above-mentioned effect cannot be obtained. For example, when an image having a low image area rate is continuously printed for a long time, the opportunity of removing aggregated toner by means of reverse rotation hardly arrives, so that an amount of aggregation increases in proportion to the length of time such printing continues. Further, even though the developer carrier is reversely rotated after a prescribed threshold is exceeded while an image formation device is stopped, the aggregated toner cannot be completely removed.

SUMMARY OF THE INVENTION

Accordingly, an object of the present invention is to provide a new and novel image forming apparatus. Such a new and novel image forming apparatus includes an image bearer that carries a latent image and a developer carrier that rotates in opposed first and second directions. The developer carrier carries developer that develops the latent image and obtains a toner image when the developer carrier only rotates in the first direction. A transfer device is provided to transfer the toner image onto a recording medium. A fixing device is provided to fix the toner image onto the recording medium. A sheet number threshold designating device is provided to designate a prescribed number of sheets as a threshold. A counter is provided to count a number of printed sheets. A controller is further provided to start a forced drive stop sequence for stopping image formation at least by stopping the rotation of the developer carrier in the first direction when the number of printed sheets reaches the threshold. The forced drive stop sequence rotates the developer carrier in the second direction for a prescribed time period when the image formation is stopped. The forced drive stop sequence stops rotation of the developer carrier in the second direction and resumes the image formation after the prescribed time has elapsed.

In another aspect, the number of printed sheets is reset when resuming the image formation.

In yet another aspect, a setting device is provided to invalidate the forced drive stop sequence.

In another aspect, the controller starts an ordinary drive stopping sequence for stopping image formation at least by stopping the rotation of the developer carrier in the first direction when a prescribed number of printed sheets have been made before arriving at the threshold and the image formation is stopped. The ordinary drive stop sequence rotates the developer carrier in the second direction for a prescribed time period when the image formation is stopped and resumes the image formation after the prescribed time has elapsed. The number of printed sheets is reset when resuming the image formation.

In another aspect, the image bearer is enabled to rotate at plural line velocities, and the threshold is changed in accordance with the line velocity.

In another aspect, an image forming apparatus operable in different color modes includes plural image bearers each carrying a latent image, and plural developer carriers each rotating in first and second directions opposite to each other. The developer carrier carries developer that develops the latent image and obtains a toner image when the developer carrier only rotates in the first direction. Plural transfer devices are provided each to transfer the toner image onto a recording medium. A fixing device is provided to fix the toner image onto the recording medium. A sheet number threshold designating device is provided to designate a prescribed number of sheets as a threshold per color mode. A counter is provided to count a number of printed sheets per color mode. A controller is provided to start a ordinary drive stopping sequence for stopping image formation at least by stopping the rotation of one of the plural developer carriers in the first direction when the number of printed sheets reaches the threshold per color mode. The ordinary drive stopping sequence rotates one of the plural developer carriers in the second direction for a prescribed time period when the image formation is stopped. The ordinary drive stopping sequence stops the rotation of one of the plural developer carriers in the second direction and resumes the image formation after the prescribed time has elapsed per color mode.

BRIEF DESCRIPTION OF DRAWINGS

A more complete appreciation of the present invention and many of the attendant advantages thereof will be readily obtained as the same becomes better understood by reference to the following detailed description when considered in connection with the accompanying drawings, wherein:

FIG. 4 schematically illustrates an exemplary correspondence between a thickness of a sheet, a line velocity of a photoconductive drum, and a prescribed setting number in the first embodiment according to the present invention;

PREFERRED EMBODIMENTS OF THE PRESENT INVENTION

Figure 1:
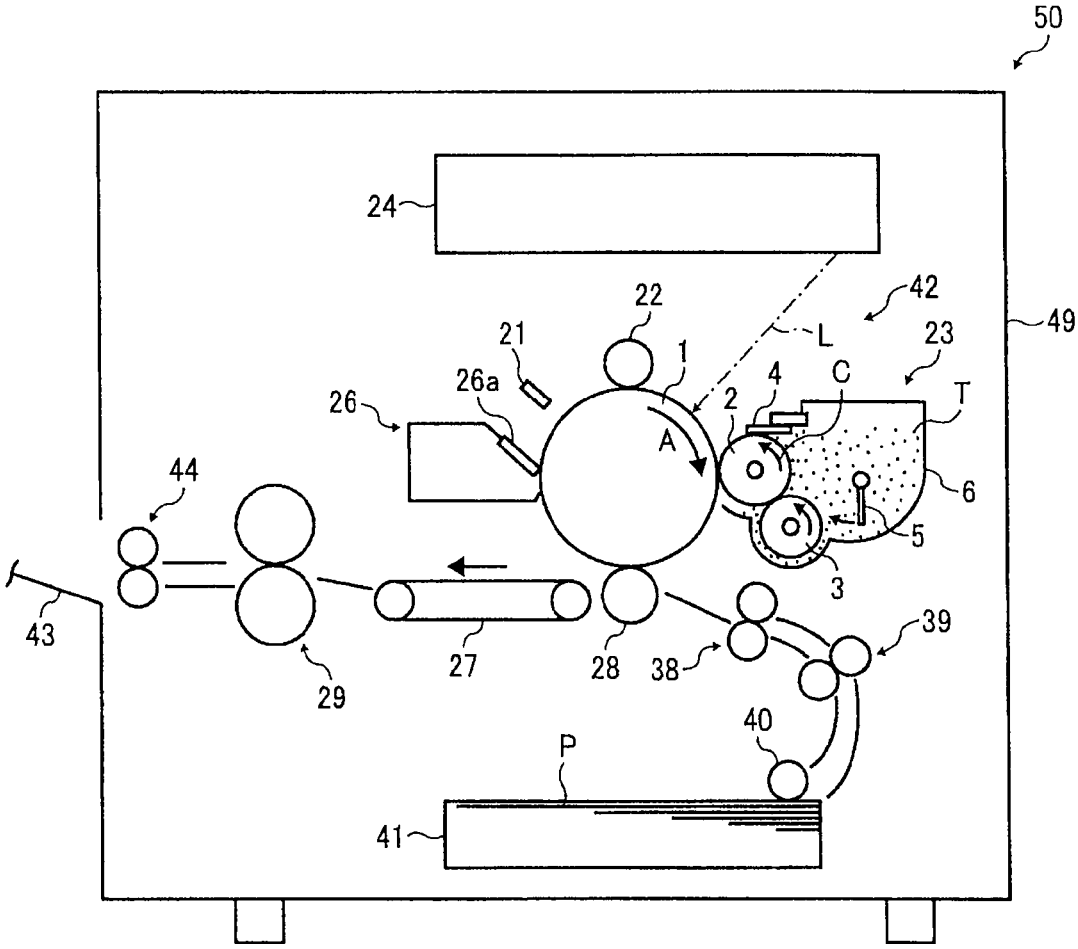
FIG. 1 schematically illustrates an exemplary image forming apparatus according to a first embodiment of the present.

Referring now to the drawing, wherein like reference numerals designate identical or corresponding parts throughout several views, in particular in FIGS. 1 to 4, the first embodiment is described. As shown in FIG. 1, an image forming apparatus 50 of a monochrome laser printer type and includes an apparatus body 49. There is provided a photoconductive drum 1 serving as an image bearer almost at the center thereof. Around the photoconductive drum 1, there is arranged an image formation section 42 for forming a monochrome black image.

In the image formation section 42, there are arranged in a direction shown by an arrow A of a solid line in an order from upstream to downstream to repeatedly form a monochrome black image, a charge roller 22 serving that provides cargoes, an exposure device 24 that emits a laser light L onto a surface of the photoconductive drum 1, a developing device 23 that visualizes a latent image formed on the photoconductive drum 1, and a cleaning device 26 that provides cleaning.

The photoconductive drum 1 is freely rotatavely supported in an arrow A showing direction (i.e., clockwise) by a casing plate, not shown, of the apparatus body 49. The exposure device 24 includes a laser diode, not shown, that generates and emits laser light in accordance with an image signal, a laser light scanning system having a latent image deflection device such as a polygon mirror that scans with the laser light from the laser diode onto the surface of the photoconductive drum 1.

The developing device 23 is arranged opposing the photoconductive drum 1 and includes a developing roller 2 that carries and conveys the toner T to a developing station created between itself and the photoconductive drum 1, so that the toner is supplied and develops the latent image formed on the surface of the photoconductive drum 1. A sheet feeding section 39 is arranged below the photoconductive drum 1 to accommodate transfer sheets P of a sheet like printing medium. The sheet feeding section 39 mainly includes a sheet feeding cassette 41 that accommodates the transfer sheets P, a sheet feeding roller 40 is arranged above the sheet feeding cassette 41 to feed the transfer sheets one by one from the topmost one, and a pair of registration rollers 38 that launches the transfer sheet fed by the sheet-feeding roller 40 at a prescribed time. On the transfer sheet conveyance path between the sheet feeding roller 40 and the pair of registration rollers 38, there are provided a transfer sheet guide plates and a pair of conveyance rollers, not shown. By replacing the sheet-feeding cassette 41, a size of the transfer sheet and a type thereof can be changed.

A transfer roller 28 is arranged between the photoconductive drum 1 and the sheet-feeding cassette 41 to contact and transfer the toner image to the transfer sheet P from the photoconductive drum 1. On the left side of a nip formed between the transfer roller 28 and the photoconductive drum 1, there is provided a conveyance belt 27 wound and driving and driven rollers to electro statically absorb and convey the transfer sheet having the toner image thereon.

On the left side of the conveyance belt 27, there are provided a fixing device having a fixing roller and a pressing roller for collectively fusing and pressing the toner image onto the transfer sheet. On the left side of a pair of sheet ejection roller 44, there is provided a sheet ejection roller 44. On the lower left side of the pair of sheet ejection rollers 44, there is provided a sheet ejection tray 43 that ejects the sheet having the toner image thereon. Thus, the sheet ejection rollers 44 and the sheet ejection tray 43 collectively constitute a sheet ejection section.

Now, exemplary general operations of image formation and printing are described with reference to FIG. 2. When printing conditions, such as a number of sheets to be printed, etc., are input thru various keys arranged on a operation section 12 of an operation panel, and printing key, not shown, is depressed, or when a signal indicating a printing instruction such as a printing condition, etc., from a computer, such as personal computer, etc., connected to the image forming apparatus 50. A toner image is formed on the photoconductive drum 1 due to performances of each device included in the image formation section 42 at a prescribed time. Specifically, as the photoconductive drum 1 rotates in an arrow A direction in FIG. 1, the outer circum surface thereof is uniformly charged by charge roller 22. Then, the laser light L is emitted in accordance with the image signal from the laser diode of the exposure device 24, and is scanned by the polygonal mirror, so that the surface of the photoconductive drum 1 is exposed to the laser light L and imaging is executed to obtain a latent image thereon. When the latent image on the photoconductive drum 1 faces the developing device 23, the developing roller 2 in the developing device 23 rotates in an arrow C showing direction as a first direction (i.e. counter clockwise). Then, the toner having one component non-magnetic type for example stored in the developing device 23 is conveyed to a developing station opposing the photoconductive drum 1 and supplied and attracted to the latent image on the surface of the photoconductive drum 1, so that a toner image is formed thereon.

The transfer sheets P accommodated in the sheet feeding cassette 41 are extracted by a sheet feeding roller 40 and a separation device, not shown, and are conveyed to the pair of registration rollers 38 one by one. The transfer sheet P is then conveyed to a transfer station in the transfer section of the photoconductive drum 1 at a prescribed time so that a tip of the transfer sheet P synchronizes with the toner image on the photoconductive drum 1. At the toner image transfer position, the toner image is transferred onto the transfer sheet under the influence of an electric field formed by the transfer roller 28, and is electro statically absorbed and conveyed by the conveyance belt 27. The transfer sheet having the toner image is separated from the conveyance belt 27 by a separation device, not shown, and is conveyed to the fixing device 29. The fixing device 29 fuses and presses and thereby fixing the toner image, so that an image is completely formed. The transfer sheet is then ejected onto a sheet ejection tray 43 via a pair of ejection rollers in the sheet ejection section.

Further, in the cleaning device 26, a cleaning blade 26*a* removes toner not completely transferred onto the transfer sheet and remaining on the surface of the photoconductive drum 1. The toner is then collected and stored in a used toner bottle, not shown, via a used toner collection path, not shown. A potential of the surface of the photoconductive drum 1 passing thru the cleaning device 26 is initialized by latent image emission of a charge remover including a charge removing lamp 21. In this way, one image formation or printing operation is executed per transfer sheet. Then, the surface of the photoconductive drum 1 is uniformly charged by a charge roller 22, and thus repeats the next image formation process as mentioned before.

Figure 2:
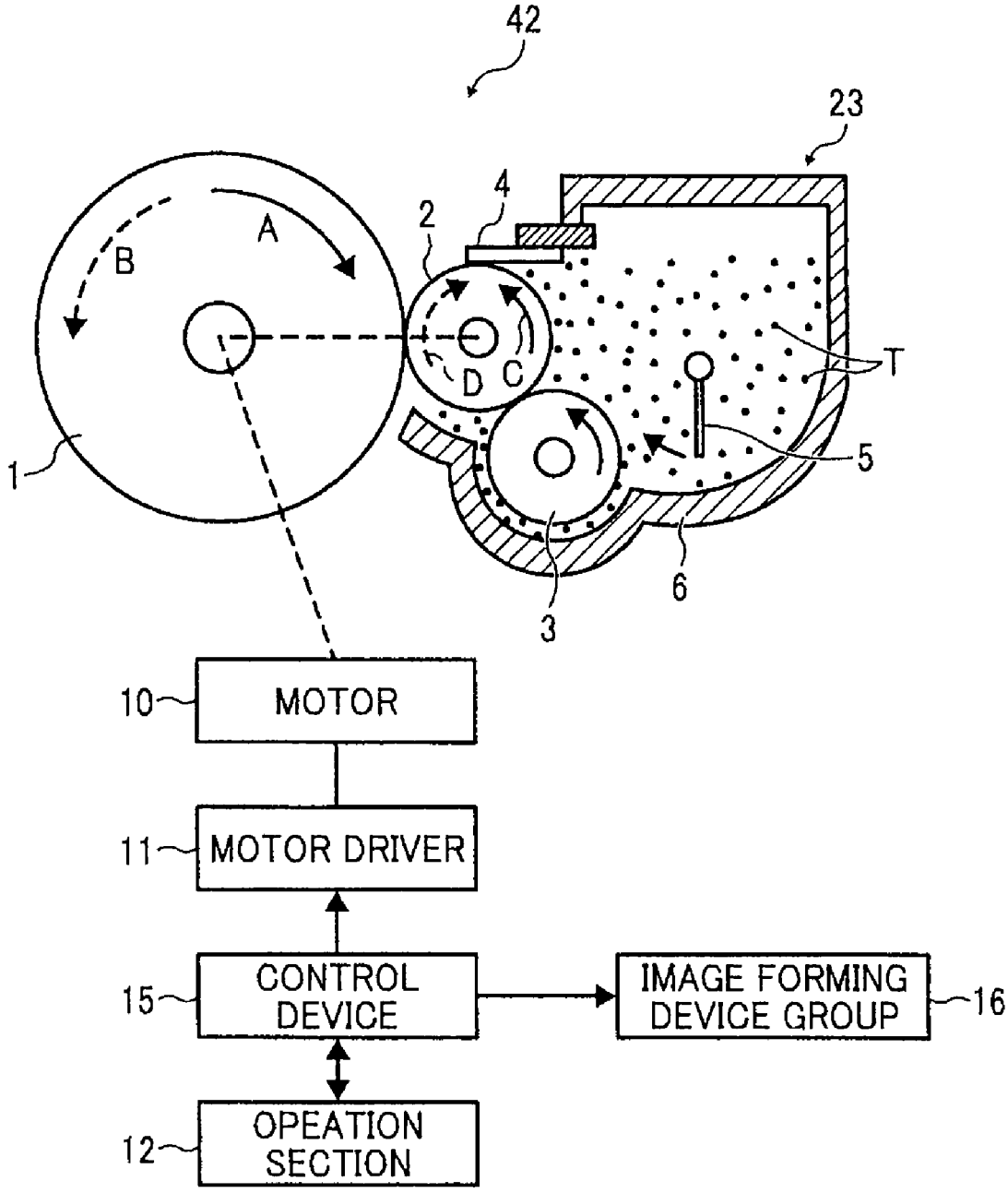
FIG. 2 schematically illustrates an exemplary control section of the image forming apparatus according to a first embodiment of the present invention.

Now, with reference to FIG. 2, an exemplary structure and the photoconductive drum 1 and the developing device 23 of the image formation section 42 is described. The photoconductive drum 1 includes a photoconductive performance capable of forming a latent image on the surface thereof, such as a well-known organic type. As shown, the photoconductive drum 1 is freely rotatavely supported clockwise and counter clockwise by a casing side plate, not shown, of the apparatus body 49 as shown by arrows A and B directions and is driven and rotated by a motor 10 that reversibly rotates and changes a velocity of a rotational velocity. The line velocity of the photoconductive drum 1 can be changed and switched by changing a rotational velocity of the motor 10 among three steps of 77, 154 and 230 mm/s in accordance with a type of sheet, i.e., three different sheet thickness (basic weight) as shown in FIG. 4. The image bearer is not limited to the photoconductive drum 1, and can include an endless belt type.

The developing roller 2 is freely rotatavely supported with both ends of its shaft being supported by a casing side wall, not shown, arranged both on the in front and rear sides of the developing device casing 6 serving as a housing. Specifically, the photoconductive drum 1 is driven and rotated both clockwise and counter clockwise in arrows C and D showing directions. The photoconductive drum 1 is linked with the developing roller 2 via a driving force tram device such as a gear train, etc., not shown, and is driven by the motor 10. In the shaft of the developing roller 2, there is provided an electromagnetic clutch, not shown, so that rotation-driving force of the motor 10 is transmitted via the electric magnetic clutch. Herein below, for ease of the description, an on/off operation of the electric magnetic clutch is omitted.

Also included in the developing device 23 is a supply roller 3 that is freely rotatavely supported by the casing wall in an arrow showing direction of a solid line, i.e., counter clockwise and supplies toner to the developing roller 2 as shown in FIGS. 1 and 2. A plate like agitator 5 freely rotatably supported by the casing wall in an arrow showing direction of a solid line, i.e., clockwise is further provided to stir developer. Further, a doctor blade 4 is included to cause the toner conveyed from the supply roller 3 and carried on the outer circumference of the developing roller 2 to have a prescribed thickness. The doctor blade 4 is fastened and secured by a faster, not shown, to an inner wall of the developing casing 6 via a metal holder. The doctor blade 4 is made of rubber elastic member such as urethane, silicone, etc.

To supply the toner to the developing roller 2 rotating in an arrow C direction, the supply roller 3 made of sponge roller sliding contacts the developing roller 2 and charges the toner 3 carried thereon due to the frication, thereby supplying the toner to the developing roller 2. Further, the doctor blade 4 smoothens the toner thin layer to have a prescribed thickness before developing while contacting the developing roller, thereby developing is executed opposing the photoconductive drum 1.

In the developing region, a prescribed bias is applied for developing via the developing roller 2. Thus, a developing electric field is created in a direction to bias the toner toward the latent image on the photoconductive drum 1. As a result, the image is developed on the photoconductive drum 1. Further, the toner passing through the developing region separates from the developing roller 2 at a nip section between the developing roller 2 and the supply roller 3, and returns to the supply roller 3. Then, the toner is moved to the agitator 5 and is thereby stirred. The toner is at the same time conveyed to the developing roller 2 from a toner replenishment section that executes replenishment as needed.

Now, an exemplary control section according to one embodiment is described with reference to FIG. 2. An instruction of image formation and printing job to the image forming apparatus 50 is executed by the computer to the user partially as mentioned above.

Otherwise, the printing instruction is executed by attaching a printing instruction-recording medium, such as a compact disc, etc., to the image forming apparatus. As shown in FIG. 2, the motor 10 is electrically connected to a control device 15 via a motor driver 11. Thus, when an instruction signal is transmitted from the control device 15 to the motor driver 11, the motor 10 is controlled to start, stop and rotational velocity.

The operation section 12 mainly includes various keys, not shown, including printing, ten-pad, and enter keys as an operation instruction device for giving an instruction of an operation to the above-mentioned each of sections of the image forming apparatus 50, and a liquid crystal display section, not shown, as a display device for informing and displaying an operation condition of the above-mentioned each of sections of the image forming apparatus 50. The liquid crystal display displays alarm when the above-mentioned forcible drive stop sequence control starts. The operation section 12 is electrically connected to a control section 15 to communicate signals therebetween. A combination of ten pad and enter keys provides a service person program, and functions as a setting device for designating a prescribed number of sheets to stop successive printing operations by the image formation device group 16 when a number of printed sheets accumulated after start of printing reaches the prescribed number of sheets during a successive printing. A successive printing condition includes a situation when printing or image formation is executed by continuously feeding a lot of sheets without interruption, such as a printing job waiting condition due to continuous printing requests, a job of printing a lot of sheets, etc.

In FIG. 2, the image formation device group 16 is arranged in the above-mentioned respective devices and sections of the image forming apparatus 50 and includes various motors as a driving device, an electro magnetic clutch, and an actuator such as, a solenoid, a heater, etc., and a driving member, such as rollers, etc. The image formation device group 16 also includes a transfer device having a transfer roller and a fixing device 29. Also included are a sheet feeding section 39, a sheet ejection section, and an actuator, such as various motors, etc., and driving members, such as rollers, etc., arranged therein. Specifically, the image formation device group 16 contributes to the image formation and printing operation meaning all control objective driving devices controlled by the control device 15. The image formation device group 16 is electrically connected to the control device 15, so that an instruction signal is transmitted from the control device 15 to the control objective driving devices control objective of the image formation device group 16.

The control device 15 include a micro computer having a RAM (hereinafter to as a backup ROM), a timer, and an I/O/I/F (Input/output port/Interface) backed up by a source, such as a battery, etc., each connected via a signal bus, not shown. The CPU of the control device 15 generally controls operations or the like of the image formation device group 16 and the liquid crystal display section of the operation section 12 of the image forming apparatus 50 in accordance with various detection signals from various sensors arranged on the apparatus body side and the an operation program read from the ROM. The CPU of the control device 15 also uniquely controls forcible and ordinary driving stop sequences. The CPU of the control device 15 also functions as a counting device for counting a number of printed sheets from start of printing during the successive printing operation, and stores a counting result into the above-mentioned RAM. The counting device can include a counter or the like provided in the control device 15 which counts printing sheet number data transmitted from the sheet ejection sensor or the like, not shown, arranged in the sheet ejection section.

The CPU initially refers to the number of printed sheets accumulated after the start of printing in the successive printing. When the number of printed sheets reaches the prescribed level designated by the above-mentioned setting device of the operation section 12 (e.g. the ten pad and enter key combination), the CPU executes the driving stop forcing sequence to forcibly stop driving of the image formation device group 16. When the developing roller 2 stops rotating in an arrow C showing direction and a rotation operation has been executed in an arrow D showing direction for a prescribed time period, the CPU immediately resumes printing while executing sequence control for resuming the driving of the image formation device group 16. As the time period for rotating in the arrow D showing direction, a rotation number or time period of the developing roller 2 in the direction preferably obtained from a test of analyzing a removal effect of aggregated toner in the developing device 23 or data experientially obtained is used. Secondary, the CPU resets the number of printed sheets stored in the RAM upon every execution of the above-mentioned driving stop forcing sequence control and completion of rotation of the developing roller 2 in the arrow D showing direction, and newly starts counting the same from restart.

The above-mentioned setting device is enabled to designate invalidation of the above-mentioned driving stop forcing sequence control as a forcible turn odd sequence. Specifically, when data signal generated by setting and confirming a prescribed number "N=0" with the ten pad key and the enter key is inputted to the CPU, the CPU recognizes invalidation of the driving stop forcing sequence control and prohibits the turn off sequence. Thus, since user friendly setting become available while invalidating the turning off function itself, an image having a low image area rate is rarely continuously fed and printer for a long time.

Further, the above-mentioned setting device can be mainly used by a service person (sometimes by a user) and designates a number of sheets per three different steps of line velocities of the photoconductive drum 1. The service person recognizes a usage manner and a request from a user of the image forming apparatus 50 and designates a prescribed number of sheets (hereinafter, referred to as a threshold number of sheets N) in accordance with user usage condition, such as 81 g/m$^2$ and a process velocity 230 mm/s, etc., in FIG. 4, in that the user frequently executes formation of an image having a low image area rate for a long time as mentioned above. Generally, since the prescribed number of sheets is used as a trigger to urgently stop operating of the image formation device group 16 during the continuous printing, it is preferably smaller than a prescribed level by few to keep a room not to cause toner aggregation. Further, to execute the forcible turning off sequence, the image formation device group 16 is preferably stopped in a condition where sheet feeding jam or the like is not caused.

Now, a relation among the a type of sheet fed, three step line velocities of the photoconductive drum 1, and a designated prescribed number of sheets is additionally explained. Specifically, it is generally or experientially known that as the sheet increases the thickness (basic weight), the sheet feeding resistance increases. Thus, the line velocity (i.e., a process velocity) of the photoconductive drum 1 needs to be decreased. As a result, a rotational velocity of the motor 10 rotating the photoconductive drum 1 in the arrow A showing direction is necessarily set being decreased, a rotational velocity of each of the developing roller 2, the supply roller 3, and the agitator 5 driven by the motor 10 decreases. Thus, in comparison with a case when the thin sheet is used, a velocity of stirring the toner in the developing device 23 is lower, and stress applied to the toner becomes relatively smaller. Thus, the toner aggregation tendency becomes weaker, while the settable prescribed number of sheets increases.

Third, the CPU has a function to execute ordinal drive stop sequence control similar to that of conventional (i.e., turn off sequence). The ordinal drive stop sequence control is executed to rotate the developing roller 2 in a arrow D showing direction for a prescribed time period when the image formation device group 16 completes printing operation and the developing roller 2 stops rotating in the arrow C showing direction. Fourth, the CPU has a function to refer to the number of printed sheets stored in the backup RAM, and resets the number of printed sheets stored in the backup RAM when the ordinal drive stop sequence control is executed before the number of printed sheets from the printing start reaches the prescribed level during the continuous printing, and resumes number of printed sheets from the printing resuming when the developing roller 2 completes rotation in the arrow D showing direction.

Figure 3:
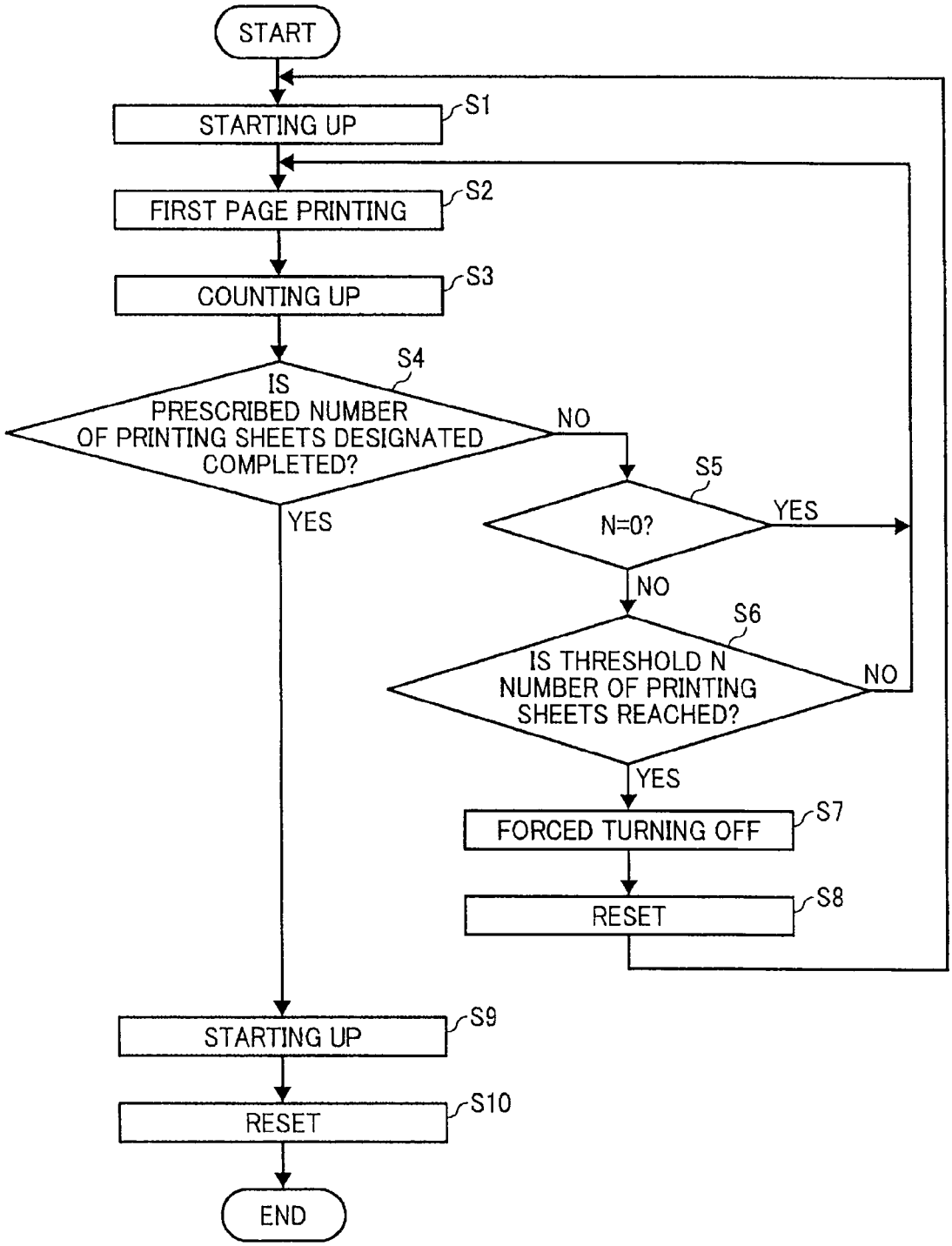
FIG. 3 schematically illustrates an exemplary sequence of an operation of an essential part of the first and second embodiments according to the present invention.

The ROM stores sequence control program controlling general operation, program shown in FIG. 3, and related data or the like. The RAM temporarily stores determination and calculating results executed in the CPU and output signals from the various sensors, not shown, various keys of the operation section 12, thereby inputting and outputting these signals. Further, into the RAM, operation program read from the ROM by the CPU is temporarily written. The backup ROM holds the number of printed sheets accumulated from start of usage of the image forming apparatus 50 even when the printing job is completed and then a main body power source of the image forming apparatus 50 is turned off.

Instead of or in addition to the ROM, the control device 15 include one of a PROM in the general meaning capable of executing programming only once, an EPROM erasable with a ultra violet latent image or the like, an EEPROM electrically erasable, and a flash memory. A service person can set a prescribed number of sheets using a service person program by combining the ten pad and enter keys as a setting device arranged on the operation section 12 into a programmable memory in accordance with usage manner or usage of the image forming apparatus by a user to forcibly stop continuous printing operation of the image formation device group 16 when the number of printed sheets accumulated from start of the printing reaches the prescribed number of sheets during the continuous printing. The setting device can change the prescribed number of sheets to stop the continuous printing operation when a service person or the like replaces the ROM chip.

Now, image quality deterioration caused when an image having a low image area rate is printed is described. When an image having a low image area rate is printed onto a transfer sheet, an amount of toner supplied from the developing device 23 to the photoconductive drum 1 for developing is small. Accordingly, much toner is kept stirred in the developing device 23. At this moment, the toner kept receiving load due to stirring and conveyance in the developing device. As a result, the toner aggregates in a developing device 23, and accumulates at a gap in a developer lifting up section, in particular at a contact section between the doctor blade and the developing roller 2, and impedes the lifting thereof, so that the abnormal image having a white line or band is sometimes created. To suppress occurrence of the abnormal image, when a developing roller or sleeve as a developer carrier stops rotation in a direction in a developing process, it is reversely rotate, so that the aggregated toner at the gap can be smashed or removed as discussed in the Japanese Patent Application Laid Open Nos. 2004-138675 and 2001-356589 as a know tech. However, in such a system, as mentioned earlier, when the turning off sequence cannot frequently be executed, for example, when an extraordinary large number of sheets or pages is requested to be printed at once, or when printing requests or jobs are successively sent, opportunity of removing the aggregated toner by the reverse rotation hardly arrives, so that an amount of aggregation increases in proportion to the time. As a result, the amount of aggregation toner increases in proportion to a time period until the opportunity, and even though the developing roller or sleeve is reversely rotated when the image formation device group is stopped, the aggregated toner cannot be completely removed.

A first exemplary operation to resolve the above-mentioned problem is described with reference to FIG. 3 and the above-mentioned control structure. As a printing operation not executing the turning off sequence for a long time, printing of an image having a low image area rate by subsequently feeding sheets for a long time is exemplified. In such a situation, even depending on ambient at a time, a toner type, and a toner density, when an image is printed onto a transfer sheet of A4 size (JIS) in a landscape direction, and an image area rate thereof is 0, 5% for a monochrome color, it is revealed experimentally or thru a test that toner aggregation occurs as a result of successive sheet feed printing for about 90 minutes in a similar model to the image forming apparatus 50. As shown in FIG. 3, it is supposed that before the image forming apparatus 50 starts printing operation, mainly a service person recognizes a usage manner and a request from a user of the image forming apparatus 50, and, for example, has designated a prescribed number N of sheets (300 sheets) representing that an image having a low image area rate is frequently successively printed for a long time on a sheet having a thickness of 81 g/m$^2$ at a process velocity of 230 mm/s, etc., as shown in FIG. 4 by combining operations of the ten pad and enter keys on the operation section 12 as mentioned above. Further supposed is that, the user successively executes printing of more than N number of sheets as a threshold (e.g. N=300).

When a printing condition, such as a prescribed number of sheets, etc., is designated for a job using the various keys on the operation section 12 and a prescribed printing key, not shown, is depressed, or a signal indicating printing instruction including the printing condition or the like is transmitted from the computer, the image formation device group 16 operates in the above-mentioned manner and a start up sequence is simultaneously executed in step S1. The CPU counts up and accumulates a number of printed sheets from start of continuous printing, and determines if the number of printed sheets reaches a prescribed number of sheets designated by a printing instruction in steps S2 to S4.

When it is determined that the number of printed sheets does not reach the prescribed number of sheets for the job, the CPU controls the sequence to advance to step S5 and further determines if N=0 (meaning the invalidation of the forced start off sequence) is designated as the threshold. Since the threshold N=300 is designated, the sequence advances to step S6.

The CPU then determines if the number of printed sheets reaches N number of sheets. If the number of printed sheets reaches such a threshold, the CPU executes the forced turn off sequence and rotates the developing roller 2 in the arrow D showing direction (i.e., a reverse operation) for a prescribed time period after stopping rotation thereof in the arrow C showing direction. The CPU then resumes the printing operation by driving the image formation device group 16 and resets and restarts counting up of a number of printed sheets again when the rotation of the developing roller 2 in the arrow D showing direction is completed in steps S7 to S8.

If the number of printed sheets does not reach the threshold N (=300 sheets) in steps S5 to S6, the counting up continues.

Whereas if the number of printed sheets reaches the prescribed number of sheets of the job in step S4, the CPU executes the (ordinary) turn off sequence for stopping the operation of the image formation device group 16 as mentioned above, and resets the number of printed sheets, thereby terminating the job of the successive printing operation in steps S9 to S10.

Specifically, the forced turn off sequence can be executed at the optimal time in accordance with user usage or the image area rate.

Further, when the forced turn off sequence is executed, a downtime not outputting images increases. However, according to this embodiment, a user who does not execute the above-mentioned successive printing and sheet feeding for printing images of the low image area rate can avoid such increase of the downtime by invalidating the function of forced turn off sequence. For example, this is realized by designating zero (N=0) as the threshold N number of sheets used in the forced turn off sequence as mentioned above.

Further, depending on tendency of aggregation of the toner and a difference of a line velocity in accordance with a feeding sheet type, necessity of the forced turn off sequence differs. Accordingly, by allowing a user to optionally designate the forced turn off sequence in accordance with a user usage manner, high productivity and image quality can be achieved at same time.

Now, a second exemplary operation is described. Different from the first exemplary operation, an ordinary drive stop sequence (i.e., an ordinary turn off sequence), not shown in the flow chart, is executed when a number of printed sheets accumulated after start of continuous printing of image formation by the image forming apparatus 50 arrives a prescribed number of sheets for a job before reaching N number of sheets (e.g. N=300) of the threshold. Specifically, it is mainly different from the first exemplary operation by that the ordinal drive stop sequence control is executed to rotate the developing roller 2 in the arrow D showing direction for a prescribed time period when the image formation device group 16 completes the prescribed amount of a printing operation for the job and the developing roller 2 stops rotating in the arrow C showing direction. Also being mainly different therefrom is that the number of printed sheets is reset when the developing roller 2 completes the reverse rotation.

In this operation, when the printing operation of the job is completed before reaching the N number of sheets as the threshold and the developing roller 2 is reversely rotated as the ordinary turn off sequence, the forced turn off sequence is not needed thereafter for a while even if printing of the low image area rate is continued. In such a situation, the number of printed sheets counted up is reset simultaneously upon completion of the ordinary turn off sequence as mentioned above. As a result, a wasteful forced turn off sequence can be avoided in the next printing.

Figure 5:
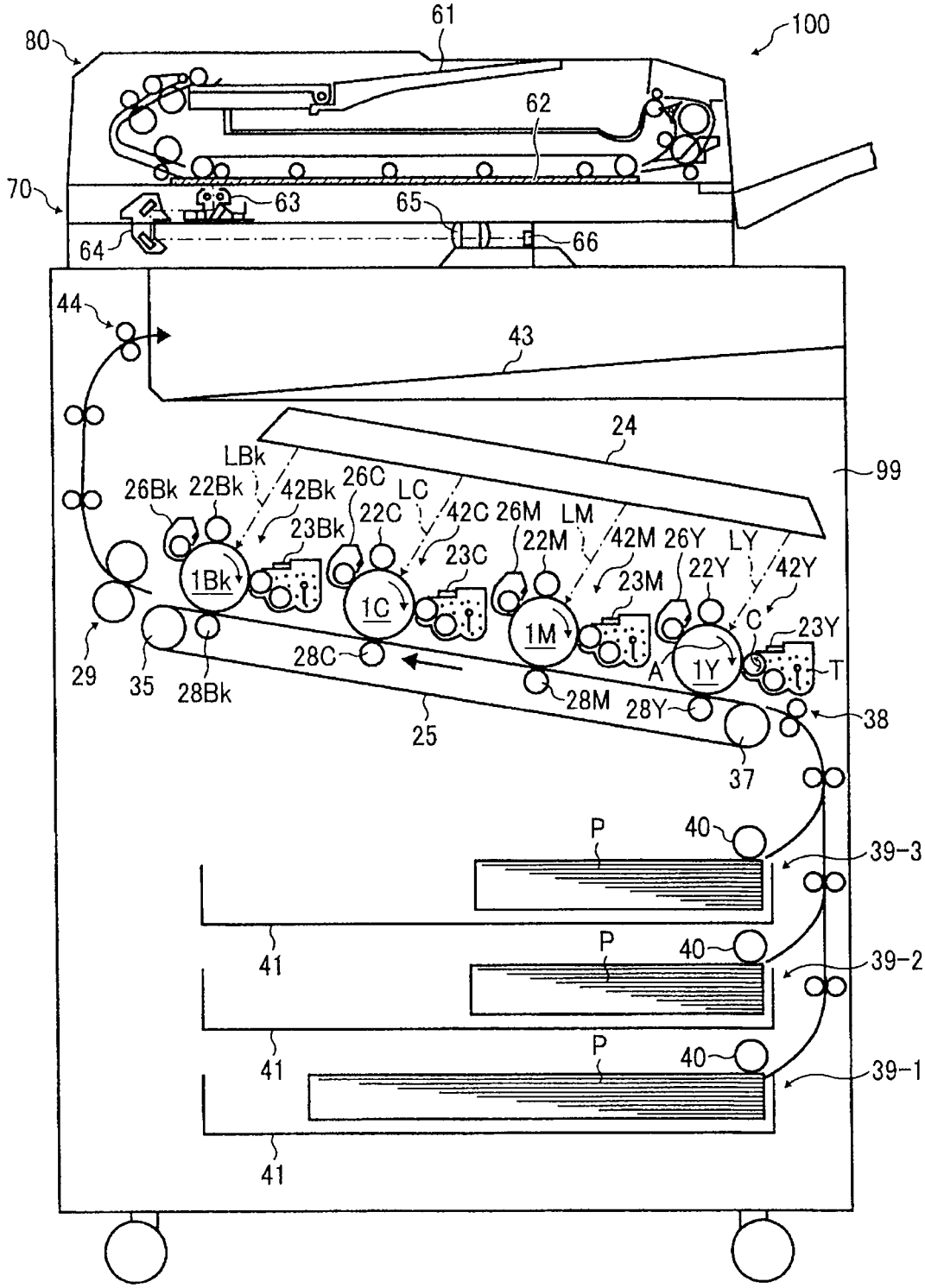
FIG. 5 schematically illustrates an exemplary color image forming apparatus of the second embodiment according to the present invention.

Now, a second embodiment is described with reference to FIGS. 5 and 6. As shown in FIG. 5, a tandem type full-color image forming apparatus 100 is a copier and includes drum state photoconductive members and developing devices or the like for respective four colors of yellow (Y), magenta (M), cyan (C), and black (Bk), and transfers toner images of the respective colors onto a transfer sheet in turn, so that a full-color image is formed thereon.

As shown, 99 denotes an apparatus body of the image forming apparatus 100. 80 denotes an automatic original document conveyance device (ADF) attached to a scanner 70. Four photoconductive drums 1Y to 1Bk are aligned obliquely upward on the left side from right to left in the apparatus body 99. Image formation sections 42Y to 42Bk are arranged to form four colors of Y to Bk adjacent to the respective photoconductive drums 1Y to 1Bk to form the full-color image. The respective image formation sections 42Y to 42Bk have substantially the structure and execute the same operations. Thus, only the image formation section 42Y for yellow arranged on the rightmost side is hereinafter described.

The image formation section 42Y mainly includes a charge device 22Y for repeatedly forming a yellow image around the photoconductive drum 1Y, an exposure device 24 for generating and emitting a laser light (i.e., an exposure latent image), and a developing device 23Y for developing and visualizing a latent image formed on the photoconductive drum 1Y. Also included is a cleaning device 26Y.

The photoconductive drum 1Y is freely relatively supported in an arrow A showing direction by a side plate of a casing, not shown. The exposure device 24 includes a laser diode, not shown, for generating and emitting a laser light in accordance with image signals of respective colors and a polygon mirror, not shown, for scanning the laser light emitted from the LASER DIODE, so that the laser light LY is emitted onto the surface of the photoconductive drum 1Y. Below the respective photoconductive drums 1Y to 1Bk of the image formation sections 42Y to 42Bk, there is provided a conveyance transfer belt 25 suspended opposing thereof for attracting and conveying the transfer sheet. Specifically, the conveyance transfer belt 25 is wound around a driving roller 35 and a driven roller 37 and travels in an arrow showing direction (e.g. counterclockwise). Specifically, the conveyance transfer belt 25 electro statically absorbs, carries and conveys the transfer sheet.

Below the respective photoconductive drums 1Y to 1Bk and opposing thereto, there are provided transfer rollers 28Y to 28Bk sandwiching the conveyance transfer belt 25, respectively. The transfer rollers 28Y to 28Bk transfer respective toner images on the photoconductive drums 1Y to 1Bk onto the transfer sheet 25 electro statically absorbed and conveyed thereto under influence of an electric field as a known function. The transfer sheet is launched from any one of sheet feeding sections 39-1 to 39-3 arranged at a lower section in the apparatus body 99 at a prescribed time onto the conveyance transfer belt 25 when selected.

The sheet feeding sections 39-1 to 39-3 have subs the same structure as that 39 employed in the first embodiment and differ from each other by a size or a thickness of sheets accommodated and stacked therein. There are provided a transfer member guide plate and a pair of conveyance rollers, not shown, on a transfer member conveyance path arranged between a pair of registration rollers 38 that transfers the sheet at a prescribed time and a sheet-feeding roller 40 that conveys the sheet.

On the left side of the apparatus body 99 as a downstream of the transfer member conveyance path, there is provided a separation device having a separation charger, not shown, opposing the driving roller 35 via the conveyance transfer belt 25 to separation the transfer sheet from the conveyance transfer belt 25. On the left side of the separation device, there is provided a fixing device 29 having a fixing roller and pressing roller for fusing, pressing, and thereby fixing respective toner images onto the transfer sheet. Further, above the fixing device 29, there is provided a pair of sheet ejection rollers 44 via a sheet ejection guide plate, not shown. On the right below side of the sheet ejection rollers 44, there is provided a sheet ejection section having a sheet ejection tray 43 for ejecting the transfer sheet with a toner image.

Now, a printing operation executed when a full-color image is formed is described. When a copy is made using the color image forming apparatus 100, an original document, not shown, is set onto an original document setting table 61 of the ADF 80. Or, the ADF is open and the original document is set onto a platen glass 62 of the scanner 70, and then the ADF 80 is closed and depresses the original document. Then, by operating the various keys on the operation section 12A of FIG. 6, a printing condition such as a prescribed number of sheets, etc., is appropriately designated, and the printing key, not shown, is depressed. the scanner 70 is driven and thus the first and second carriages 63 and 64 run immediately when original document is set onto the platen glass or after the original document is automatically conveyed onto the platen glass 62 by the conveyance roller when the original document is set to the ADF 80.

Then, a light source of the first carriage 63 emits latent image while a reflection latent image from the original document surface advances to the second carriage 64. The latent image is then reflected by a mirror of the second carriage 64 and enters a color-reading sensor 66 via an imaging lens 65. Color image info of the original document is read by the color-reading sensor 66 per RGB (i.e., red, green, blue), and is converted into an electrical image signal. Further, based on the color resolution image signal of the RGB, color conversion processing, color correction processing, and space freq correction processing or the like are executed in the image processing section, not shown, so that color image info of the yellow, magenta, cyan, and black can be obtained. These color image info of the yellow, magenta, cyan, and black are transmitted to the exposure device 24.

Further, without image info of the original document as mentioned above in the first embodiment, the printing operation can off course be executed by transmitting a signal including a printing inst having a printing condition or the like from the computer such as personal computer, etc., connected to the color image forming apparatus 100. Even not described in the first embodiment, the scanner 71 and the ADF 80 are employed and a printing operation can be executed based on the image info of the original document. A driving device/actuator, such as a motor, etc., and a control objective driving device including a driving member such as various rollers, etc., employed in both of the embodiments constitute image formation device group 016 and 16A.

Then, the image formation sections 42Y to 42Bk operate at prescribed times and form toner images of the respective colors on the photoconductive drums 1Y to 1Bk, respectively. For example, when the photoconductive drum 1Y rotates in the arrow A showing direction, the outer surface thereof is uniformly charged by the charge device 22Y in the image formation section 42Y. Then, a laser light LY is emitted from the LASER DIODE of the exposure device 24Y in accordance with an image signal. The polygon mirror scans the laser light and executes exposure and imaging on the photoconductive drum 1Y, so that a latent image corresponding to a yellow component is formed. When the latent image on the photoconductive drum 1Y faces the developing device 23Y, the developing roller 2 conveys non-magnetic one component to stored in the developing device 23Y to the developing region opposing the photoconductive drum 1Y and accordingly to the latent image on the surface of the photoconductive drum 1Y. Thus, the latent image is developed to be a visualized yellow toner image on the photoconductive drum 1Y. In the other color image formation section 42M to 42Bk, respective colors are similarly formed as in the image formation section 42Y.

The transfer sheet accommodated in the sheet-feeding cassette 41 is withdrawn by the sheet-feeding roller 40, and fed to the pair of registration roller 38 along the transfer member path. Then, the pair of registration rollers 38 feeds the sheet toward a transfer region of the photoconductive drum 1Y so that a leading end thereof synchronizes with a toner image of a first color of yellow formed on the photoconductive drum 1Y. Due to influence of an electric field created by the transfer device 28Y at a toner image transfer position for the first color of yellow, the yellow toner image is transferred onto the transfer sheet. The transfer sheet is electro statically attracted to the conveyance transfer belt 25 and is conveyed by the conveyance transfer belt 25 at same time. The transfer sheet with the yellow toner image is sequentially conveyed thru respective transfer positions between transfer devices 28M to 28Bk and the photoconductive drums 1M to 1Bk, so that cyan to black toner images formed on the respective photoconductive drums 1M to 1Bk are sequentially superimposed thereon, thereby a full color toner image is formed on the transfer sheet.

The transfer sheet with the full-color toner image is separated from the conveyance transfer belt by the separation device and is conveyed to the fixing device 29. The full-color toner image is fused pressed and fixed so that a full-color image is created. The transfer sheet with the fixed full-color image is then ejected onto a sheet ejection tray 43 via the pair of sheet ejection rollers 44.

In the cleaning device 26Y, toner not transferred onto the transfer sheet and remaining on the surface of the photoconductive drum 1Y is removed by the cleaning blade, and is collected and stored in a used toner bottle, not shown, thru a used toner collection path. Then, the surface of the photoconductive drum 1Y passing thru the cleaning device 25Y passes thru a charge removing section, not shown, thereby competing a series of an image formation process in the image formation section 42Y. After that, the charge device 22Y uniformly charges the surface and repeats the next image formation steps. Similar operations are executed in the rest of the image formation sections 42Y to 42Bk. The surface of the conveyance transfer belt 25 is subjected to cleaning of the transfer belt cleaning device, not shown, arranged below the driven roller 37 in the vicinity thereof, so that foreign matter is removed and collected there from.

Figure 6:
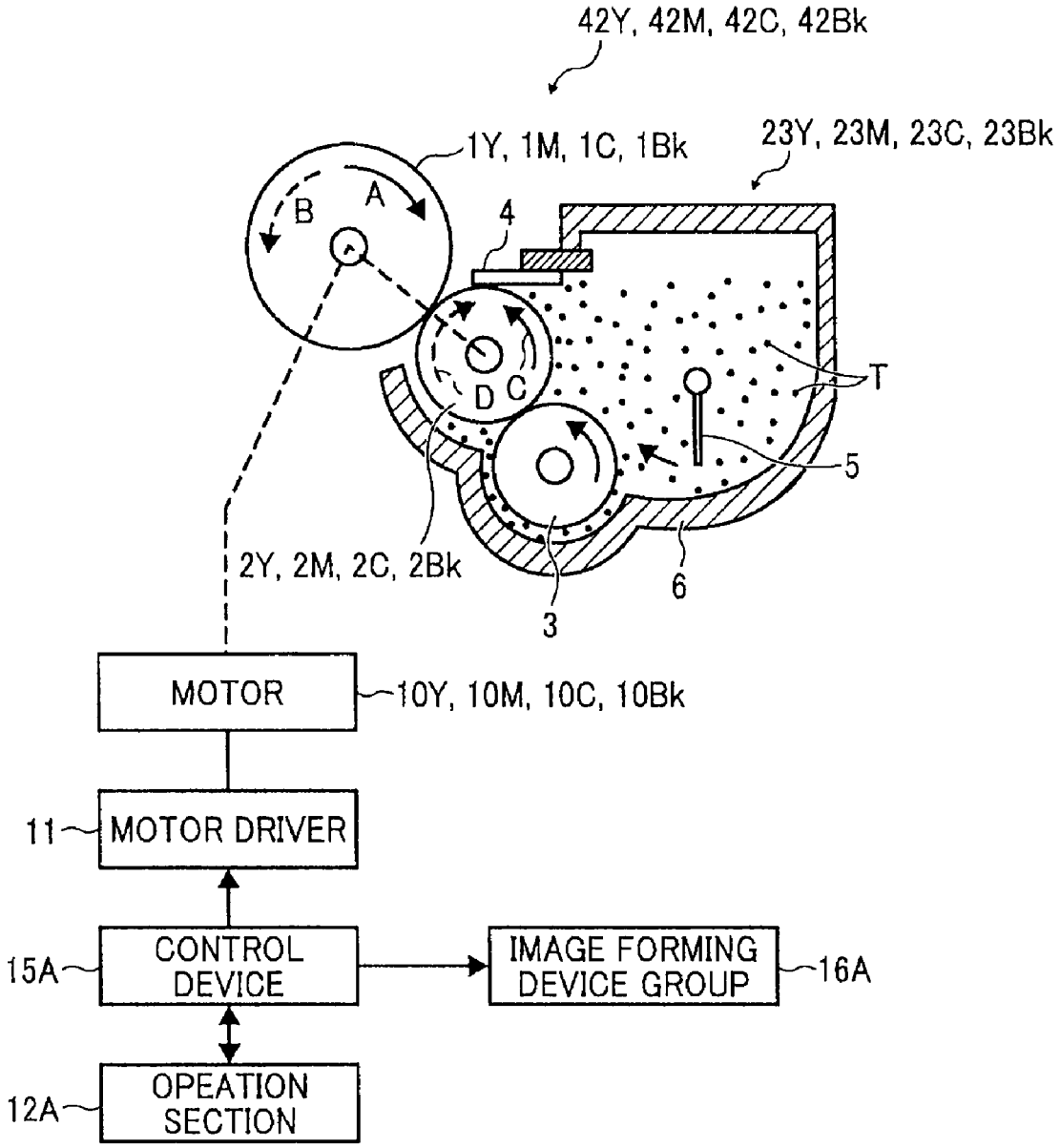
FIG. 6 schematically illustrates exemplary surroundings of a developing device together with the control section of the second embodiment according to the present invention.

Each of surroundings of the developing devices 23Y to 23Bk of the image formation sections 42Y to 42Bk provided in the full-color image forming apparatus 100 is structured as shown in FIG. 6. Specifically, an image formation section, a photoconductive drum, a developing device, a developing roller, and motor are provided in each of the surroundings. Now, exemplary structure and operation of the second embodiment, different from those of the first embodiment, are described.

The respective photoconductive drums 1Y to 1Bk are driven and rotated by motors 10Y to 10Bk capable of changing as rotational velocity in both rotation direction and arranged therein. The motors 10Y to 10Bk are connected to a control device 15A via a motor driver 11. Thus, when the control device 15A transmits an instruction signal to a motor driver 11, the motors 10Y to 10Bk are controlled to start and stop their operation as well as to change rotational velocity thereof. The line velocity of the photoconductive drums 1Y to 1Bk can be changed and switched among three steps of 77, 154 and 230 mm/s in accordance with three types of sheet, i.e., sheet thickness (basic weight) as shown in FIG. 4, by changing a rotational velocity of the motors 10Y to 10Bk, respectively.

Since structure of the respective surroundings is the same and only differ from each other by color of the toner, the image formation section 42Y and the developing device 23Y are typically described hereinafter. The photoconductive drum 1Y is engaged with a driving force transmission device such as a gear train or the like, not shown, and is driven and rotated by the motor 10Y. Further, an electro magnetic clutch, not shown, is installed in a shaft section of the developing roller 2Y. Thus, a rotation driving force of the motor 10 is transmitted to the developing roller 2Y via the electric magnetic clutch.

Now, an exemplary control structure is described with reference to FIG. 6. As partially mentioned above, an instruction of image formation and printing job to the color image forming apparatus 100 is provided by operating the various keys on the operation section 12A or transmitted from the computer, such as a personal computer, etc., connected to the color image forming apparatus 100. Otherwise, the printing instruction is provided by attaching a printing instruction-recording medium, such as a compact disc, etc., to the image forming apparatus 100. As show, in comparison with those of the first embodiment of FIG. 2, the followings are different therefrom. Specifically, an operation section 12A is used instead of the operation section 12. The motors 10Y to 10Bk provided in the photoconductive drums 1Y to 1Bk, respectively, are used. A control device 15A is used instead of that of 15. An image formation device group 16A is used instead of that of 16.

The operation section 12A is enabled to accept various setting per color mode different from that of 12 of the first embodiment, and the rest of that is substantially the same to that in the first embodiment. The operation section 12A mainly includes various keys, not shown, having a printing key, ten-pad keys, and an enter key or the like, that provides an operation instruction to respective devices and sections of the color image forming apparatus 100 and a liquid crystal display section, not shown, that informs and displays operation conditions of those. The liquid crystal display section is enabled to alarm when the later mention driving stop forcing sequence control is entered. The operation section 12A is electrically connected to the control device 15A to communicate a signal with each other. A combination of inputs of the various keys of the operation section 12A, such as those of the ten pad keys and the enter key, etc, serves as service person program, and a setting device for designating a prescribed threshold number of sheets used to forcibly stop the continuous operation of the image formation device group 16 when exceeded by a number of printed sheets accumulated after start of continuous printing operation per color mode.

As shown in FIG. 2, the image formation device group 16A includes a transfer device having transfer rollers 28Y to 28Bk and a fixing device 29 beside an actuator, such as an electric magnetic clutch, a solenoid, etc., and a driving member, such as roller, etc. Further included are a sheet feeding section 39, the above-mentioned sheet ejection section, an actuator, such as various motors, etc., and a driving member, such as rollers, etc. Specifically, the image formation device group 16A contributes to image formation and printing operation of the color image forming apparatus 100 and includes all of control objective driving devices controlled by the control device 15A. The image formation device group 16A is electrically connected to the control device 15A, so that an instruction signal from the control device 15A is transmitted to a control objective driving device of the image formation device group 16A.

The control device 15A includes a microcomputer having the same structure as the control device 15 of the first embodiment. Based on various signals from the operation section 12A, various detection signals from the various sensors arranged on the apparatus body 99, and operation program read from the ROM, the CPU of the control device 15A controls operations of the image formation device group 16A and the liquid crystal display section of the operation section 12A, and accordingly, generally controls the color image forming apparatus 100. The CPU of the control device 15A also controls the driving stop forcing sequence and a ordinary drive stop sequence per unique color mode in this embodiment as mentioned later in detail. The CPU of the control device 15A serves as a counting device for counting an accumulation number of sheets accumulated from start of the continuous printing and stores the same in the RAM of the control device 15A.

The CPU first refers to the number of printed sheets accumulated from start of the continuous printing and stored in the RAM. The CPU enters the driving stop forcing sequence control to forcibly stop driving of the image formation device group 16A when the number of printed sheets reaches a prescribed sheet setting number designated by the combination of inputs of the ten pad keys and the enter key, so that the developing rollers 2Y to 2Bk stop rotating in the arrow C showing direction and then rotates in the arrow D showing direction for a prescribed time. After that, the CPU further immediately execute sequence control for resuming driving of the image formation device group 16A and causes the printing to resume. To determine the prescribed time, a number of reverse rotations of the developing rollers 2Y to 2Bk in the arrow D showing direction or its time period is preferably designated empirically or in accordance with data obtained from a result of a test of removal of toner aggregated in the developing devices 23Y to 23Bk. Second, the CPU resets the number of printed sheets stored in the RAM and resumes printing and starts counting a number of printed sheets again from each time when the developing rollers 2Y to 2Bk complete rotation in the arrow D showing direction.

The above-mentioned setting device can also designate a condition such that the forced turn off sequence executed by the CPU is invalidated depending on color of an image formation mode. For example, when the numeral value 0 is designated and set to the sheet number N using the ten-pad keys, a data signal is then confirmed by depression of the enter key, and is input to the CPU, the CPU recognizes that the driving stop forcing sequence control is to be invalidated, and prevents the to control. Thus, since setting in accordance with a user usage becomes possible, and the to control can be invalidated per color mode. Thus, a needless down time can be reduced for a user who rarely continuously feeds sheets to print images having a low image area rate, and accordingly does not need the to control.

The above-mentioned setting device (e.g. the combination of inputs of the above-mentioned keys) can execute designation per line velocity of the photoconductive drum 1 changing in three steps and color mode as shown in FIG. 4 as one example. Specifically, a service person in charge recognizes a user usage manner and his or her request as to the color image forming apparatus 100, and designates and sets a prescribed sheet (threshold) number N of 500 sheets by combining inputs of the above-mentioned keys of the operation section 12A in accordance with the user usage condition that continuous printing of images having a low image area rate for a long time is frequently executed, such as when a sheet thickness is 169 g/m$^2$ is fed at the process velocity of 154 mm/s.

Third, the CPU executes an ordinary drive stop sequence (sometimes referred to as a turn off sequence) similar to the conventional one. The ordinary drive stop sequence of this embodiment controls such that when an number of printed sheets accumulated after start of usage of the color image forming apparatus 100 reaches a prescribed number of sheets, per color mode the developing rollers 2Y to 2Bk are rotated in an arrow D showing direction for a prescribed time period after when the image formation device group 16A completes printing operation and they stop rotating in an arrow C showing direction. Fourth, the CPU refers to the number of printed sheets stored in the backup RAM, and recognizes that the ordinary drive stop sequence is executed per color mode before the number of printed sheets accumulated from start of the continuous printing reaches a prescribed number of sheets, the CPU resets the number of printed sheets stored in the backup RAM and restarts counting the number of printed sheets when the developing rollers 2Y to 2Bk complete rotating in the arrow D showing direction and resumes the printing. Instead of or in addition to the ROM, the control device 15A includes one of a PROM in the general meaning capable of executing programming only once, an EPROM erasable with a ultra violet latent image or the like, an EEPROM electrically erasable, and a flash memory.

Now, deterioration of image quality appearing when full-color printing is executed from an image having a low image area rate is described. Specifically, a situation where an image to be printed onto a transfer sheet has a low image area rate while the same amount of toner of respective color are spent in average is described. In such a condition, an amount of toner supplied from the developing devices 23Y to 23Bk to the photoconductive drums 1Y to 1Bk small, and accordingly, a lot of toner is continuous stirred in the developing devices 23Y to 23Bk. At this moment, the toner continuously receives mechanical load during stirring and conveyance in the developing devices 23Y to 23Bk. Thus, the toe aggregates in the developing devices 23Y to 23Bk and accumulates at the contact section between the doctor blade 4 and developing rollers 2Y to 2Bk and blocks lifting of the developer (toner). As a result, an abnormal image such as a white line or band sometimes appears. To suppress occurrence of the abnormal image, a developing roller or sleeve as a developer carrier is reversely rotated when stopping its rotation in a direction, so that the aggregated toner at the gap can be smashed or removed as discussed in the Japanese Patent Application Laid Open Nos. 2004-138675 and 2001-356589 as a known technology. However, in such a system, as mentioned earlier, when the turning off sequence cannot frequently be executed, for example, when an extraordinary large number of sheets or pages is requested to be printed at once, or when printing requests or jobs are successively sent, opportunity of removing the aggregated toner by the reverse rotation hardly arrives, so that an amount of aggregation increases in proportion to the time. As a result, the amount of aggregation toner increases in proportion to a time period until the opportunity, and even though the developer roller or the developing sleeve is reversely rotated when the image formation device group is stopped, the aggregated toner cannot be completely removed. Now, an exemplary first operation is described with reference to the above-mentioned control structure and FIG. 3.

A third operation example is now described with reference to FIG. 3. As shown, it is supposed that mainly a service person recognizes both a user usage manner and a request from a user as to the color image forming apparatus 100 before a full-color printing operation starts. It is also supposed that he or she has designated 500 sheets as the N number of sheets, expecting that an image having a low image area rate is frequently successively printed for a long time on a sheet having a thickness of 169 g/m$^2$ at a process velocity of 154 mm/s as shown in FIG. 4. Specifically, he or she executed such designation by combining inputs to the ten pad and enter keys on the operation section 12A as mentioned above. Further supposed is that, the user successively executes printing more than 500 sheets. Further, it is further premised that an image to be printed onto a transfer sheet has a low image area rate and the same amount of toner is spent in each of respective colors on average.

When a printing condition such as a number of sheets, etc., is designated for a job through the various keys on the operation section 12A and a printing key is depressed, or a signal indicating a printing instruction, such as a printing condition, etc., is transmitted from a computer, the image formation device group 16A operates as mentioned above, and a start up sequence of image formation and printing operation is executed in step S1. The CPU counts up the number of printed sheets from a first sheet on successive printing, and determines if the number of printed sheets reaches the number of sheets designated during the successive printing in steps S2 to S4. When it is determined that the number of printed sheets does not reaches the designated number of sheets, the CPU controls the sequence to advance to step S5, and further determines if a threshold N=0 is designated. In this operation example, since the threshold N=500 is designated, the sequence advances to step S6.

In step S6, the CPU determines if the number of printed sheets reaches N number of the printing sheet threshold of 500 sheets. If the number of printed sheets reaches the threshold, the CPU executes the forced turn off sequence, and reversely rotates the developing rollers 2Y to 2Bk in the arrow D showing direction for a prescribed time period after stopping their rotation in the arrow C showing direction. Then, the CPU immediately resumes the printing operation by driving the image formation device group 16A while resetting and restarting the counting up of the number of printed sheets again when the rotation of the developing rollers 2Y to 2Bk in the arrow D showing direction are completed in steps S7 to S8. If the number of printed sheets does not reaches the threshold in steps S5 to S6, the counting up continues. Whereas if the number of printed sheets reaches the number of sheets designated by the printing instruction in step S4, the CPU executes the turnoff sequence to stop driving of the image formation device group 16A in the above-mentioned manner, and resets the number of printed sheets, thereby terminating the printing job in steps S9 to S10.

According to the third operation example, the forced turn off sequence is executed and the developing rollers 2Y to 2Bk are reversely rotated at the optimum time in accordance with the user usage manner or the image area rate.

Thus, regardless of the continuous operation of printing for a long time, the developing rollers 2Y to 2Bk can be periodically rotated reversely. When the forced turn off sequence is executed, a downtime not outputting images increases. However, according to this embodiment, a user who does not execute the above-mentioned successive printing and sheet feeding for printing images of the low image area rate can avoid such increase of the downtime by invalidating the function of forced turn off sequence. For example, this is realized by designating zero (N=0) as the threshold N number of sheets used in the forced turn off sequence as mentioned above.

Further, depending on tendency of aggregation of the toner and a difference of a line velocity in accordance with a feeding sheet type, necessity of the forced turn off sequence differs. Accordingly, by allowing a user to optionally designate the forced turn off sequence in accordance with a user usage manner, high productivity and image quality can be achieved at same time.

A fourth operation example is now described. Even not illustrated in the sequence, instead of step S4 of the operation example 3, an ordinary drive stop sequence (i.e., an ordinary turn off sequence) is executed when the number of printed sheets accumulated after start of the color image forming apparatus 100 reaches a prescribed number of sheets designated before reaching the threshold N number of sheets (e.g. N=500). Specifically, it is different from the third operation example by that the developing rollers 2Y to 2Bk are rotated in the arrow D showing direction for a prescribed time period after stop rotating in the arrow C showing direction.

Further being different from the third operation example is that the number of printed sheets is reset when the developing rollers 2Y to 2Bk complete such reverse rotation.

In this operation, when the printing operation of the job is completed before reaching the N number of printed sheets of the threshold and the developing rollers 2Y to 2Bk are reversely rotated as the ordinary turn off sequence, the forced turn off sequence is not needed in respective colors thereafter for a while even if printing of the low image area rate is continued. In such a situation, the number of printed sheets counted up is reset simultaneously upon completion of the ordinary turn off sequence as mentioned above. As a result, a wasteful forced turn off sequence can be avoided in the next printing in respective colors.

A fifth operation example of black monochrome color printing is now described. Since only a Black color image formation section 42Bk (i.e., a developing device 23Bk) operates, and remaining image formation sections 42B to 42Y (i.e., developing devices 23M to 23Y) do not operate in a driving system, almost similar operations to the first and second exemplary operations of the first embodiment are executed.

Now, an image area rate and tendency of aggregation per toner color are described. When a full-color image is to be printed, as the image area rate is low, toner income and expenditure decreases. Specifically, since the same color toner is stirred in the respective developing devices 23Y to 23Bk for a long time, the toner becomes readily aggregates. For example, when magenta mono color printing is executed, the toner Bk to Y other than magenta M are kept stirred in the respective developing devices 23Bk to 23Y therein, they become relatively readily aggregate than the magenta. Thus, in view of this point, necessity of the forced turn off sequence and a prescribed number of sheets are preferably determined. For example, in case of printing in the magenta mono color, the forced turn off sequence is neglected in the image formation section 42M. Otherwise, in the image formation sections 42Bk to 42Y, the N number of sheets causing the forced turn off sequence are designated smaller than that for the image formation section 42M.

Now, toner aggregation tendency other than the above is described. It is generally known that as temperature inside the developing device is high, the toner stored therein tends to aggregates. Actually, by applying an airflow design to the developing device, temperature increase therein is suppressed. However, in a tandem layout system where the image formation sections 42Bk to 42Y (i.e., the developing devices 23Bk to 23Y) are arranged side by side, and when a ventilating inlet is arranged on the side of the image formation section 42Y (the developing device 23Y) while the image formation section 42Bk is arranged farthest from the ventilating inlet, as cooling efficiency of the image formation section (i.e. the developing device) deteriorates as located on the side of the image formation section 42Bk (i.e. the developing device 23Bk) than that of 42Y (i.e. the developing device 23Y). For these reason, toner aggregation tendency sometimes changes per toner color. Accordingly, and in view of this point, necessity of the forced turn off sequence and a prescribed N number of sheets (i.e., a threshold number of sheets) are preferably determined. For example, the forced turn off sequence is neglected in the image formation section 42Y (i.e., the developing device 23Y) as being closest to the ventilating inlet. Otherwise, in the image formation section as close to the image formation section 42Bk (i.e., the developing device 23Bk), N number of sheets (threshold number of sheets) causing the forced turn off sequence are designated smaller than that for the image formation section 42Y (i.e., the developing device 23Y).

As mentioned above, the necessity of the forced turn off sequence depends on the image area rate and tendency of the toner aggregation per toner color. Accordingly, by enabling a system to optionally designate the forced turn off sequence and the prescribed threshold number of sheets per user usage, productivity and image quality stability can be doubled.

In the above, instead of the one component developer, two component developer including toner and carrier can be employed. The toner can include powder type and polymerization type. Instead of the direct transfer type, a direct transfer type employing an intermediate transfer belt can be used.

The present invention can be applied to every image forming apparatus, and in particular to that including a developer thickness-adjusting device provided at a gap pf a developer lifting section.

ADVANTAGE

By optionally enabling designation of usage of forced turn off sequence per user usage manner, productivity and image quality stability can be established at same time.

Because, according to a first exemplary, as a printing operation not executing the turning off sequence for a long time, printing of an image having a low image area rate by subsequently feeding sheets for a long time is exemplified. In such a situation, even depending on ambient at a time, a toner type, and a toner density, when an image is printed onto a transfer sheet of A4 size (JIS) in a landscape direction, and an image area rate thereof is 0, 5% for a monochrome color, it is revealed experimentally or thru a test that toner aggregation occurs as a result of successive sheet feed printing for about 90 minutes in a similar model to the image forming apparatus 50. As shown in FIG. 3, it is supposed that before the image forming apparatus 50 starts printing operation, mainly a service person recognizes a usage manner and a request from a user of the image forming apparatus 50, and, for example, has designated a prescribed number N of sheets (300 sheets) representing that an image having a low image area rate is frequently successively printed for a long time on a sheet having a thickness of 81 g/m$^2$ at a process velocity of 230 mm/s, etc., as shown in FIG. 4 by combining operations of the ten pad and enter keys on the operation section 12 as mentioned above. Further supposed is that, the user successively executes printing of more than N number of sheets as a threshold (e.g. N=300).

When a printing condition, such as a prescribed number of sheets, etc., is designated for a job using the various keys on the operation section 12 and a prescribed printing key, not shown, is depressed, or a signal indicating printing instruction including the printing condition or the like is transmitted from the computer, the image formation device group 16 operates in the above-mentioned manner and a start up sequence is simultaneously executed in step S1. The CPU counts up and accumulates a number of printed sheets from start of continuous printing, and determines if the number of printed sheets reaches a prescribed number of sheets designated by a printing instruction in steps S2 to S4.

When it is determined that the number of printed sheets does not reach the prescribed number of sheets for the job, the CPU controls the sequence to advance to step S5 and further determines if N=0 (meaning the invalidation of the forced start off sequence) is designated as the threshold. Since the threshold N=300 is designated, the sequence advances to step S6.

The CPU then determines if the number of printed sheets reaches N number of sheets. If the number of printed sheets reaches such a threshold, the CPU executes the forced turn off sequence and rotates the developing roller 2 in the arrow D showing direction (i.e., a reverse operation) for a prescribed time period after stopping rotation thereof in the arrow C showing direction. The CPU then resumes the printing operation by driving the image formation device group 16 and resets and restarts counting up a number of printed sheets again when the rotation of the developing roller 2 in the arrow D showing direction is completed in steps S7 to S8.

If the number of printed sheets does not reach the threshold N (=300 sheets) in steps S5 to S6, the counting up continues.

Whereas if the number of printed sheets reaches the prescribed number of sheets of the job in step S4, the CPU executes the (ordinary) turn off sequence for stopping the operation of the image formation device group 16 as mentioned above, and resets the number of printed sheets, thereby terminating the job of the successive printing operation in steps S9 to S10.

Specifically, the forced turn off sequence can be executed at the optimal time in accordance with user usage or the image area rate.

Further because, when the forced turn off sequence is executed, a downtime not outputting images increases. However, according to this embodiment, a user who does not execute the above-mentioned successive printing and sheet feeding for printing images of the low image area rate can avoid such increase of the downtime by invalidating the function of forced turn off sequence. For example, this is realized by designating zero (N=0) as the threshold N number of sheets used in the forced turn off sequence as mentioned above.

Further because, depending on tendency of aggregation of the toner and a difference of a line velocity in accordance with a feeding sheet type, necessity of the forced turn off sequence differs. Accordingly, by allowing a user to optionally designate the forced turn off sequence in accordance with a user usage manner, high productivity and image quality can be achieved at same time.

According to the second exemplary operation, different from the first exemplary operation, an ordinary drive stop sequence (i.e., an ordinary turn off sequence), not shown in the flow chart, is executed when a number of printed sheets accumulated after start of continuous printing of image formation by the image forming apparatus 50 arrives a prescribed number of sheets for a job before reaching N number of sheets (e.g. N=300) of the threshold. Specifically, it is mainly different from the first exemplary operation by that the ordinal drive stop sequence control is executed to rotate the developing roller 2 in the arrow D showing direction for a prescribed time period when the image formation device group 16 completes the prescribed amount of a printing operation for the job and the developing roller 2 stops rotating in the arrow C showing direction. Also being mainly different therefrom is that the number of printed sheets is reset when the developing roller 2 completes the reverse rotation.

In this operation, when the printing operation of the job is completed before reaching the N number of sheets as the threshold and the developing roller 2 is reversely rotated as the ordinary turn off sequence, the forced turn off sequence is not needed thereafter for a while even if printing of the low image area rate is continued. In such a situation, the number of printed sheets counted up is reset simultaneously upon completion of the ordinary turn off sequence as mentioned above. As a result, a wasteful forced turn off sequence can be avoided in the next printing.

Numerous additional modifications and variations of the present invention are possible in latent image of the above teachings. It is therefore to be understood that within the scope of the appended claims, the present invention may be practiced otherwise that as specifically described herein.

What is claimed is:

1. An image forming apparatus, comprising:

an image bearer configured to carry a latent image;

a developer carrier configured to rotate in opposed first and second directions, said developer carrier carrying developer developing the latent image and obtaining a toner image only when said developer carrier rotates in the first direction;

a transfer device configured to transfer the toner image onto a recording medium;

a fixing device configured to fix the toner image onto the recording medium;

a sheet number threshold designating device configured to designate a prescribed number of sheets as a threshold;

a counter configured to count a number of printed sheets;

a controller configured to start a forced drive stop sequence for stopping image formation at least by stopping the rotation of the developer carrier in the first direction when said number of printed sheets reaches the threshold, wherein, in said forced drive stop sequence, the controller causes the developer carrier to rotate in the second direction for a prescribed time period when the image formation is stopped, and to stop the rotation of the developer carrier in the second direction and resume the image formation after the prescribed time has elapsed; and a setting device configured to invalidate the forced drive stop sequence.

2. The image forming apparatus as claimed in claim 1, wherein said number of printed sheets is reset when resuming the image formation.

3. An image forming apparatus, comprising:

an image bearer configured to carry a latent image;

a developer carrier configured to rotate in opposed first and second directions, said developer carrier carrying developer developing the latent image and obtaining a toner image only when said developer carrier rotates in the first direction;

a transfer device configured to transfer the toner image onto a recording medium;

a fixing device configured to fix the toner image onto the recording medium;

a sheet number threshold designating device configured to designate a prescribed number of sheets as a threshold;

a counter configured to count a number of printed sheets; and a controller configured to start a forced drive stop sequence for stopping image formation at least by stopping the rotation of the developer carrier in the first direction when said number of printed sheets reaches the threshold, wherein, in said forced drive stop sequence, the controller causes the developer carrier to rotate in the second direction for a prescribed time period when the image formation is stopped, and to stop the rotation of the developer carrier in the second direction and resume the image formation after the prescribed time has elapsed, wherein said controller starts an ordinary drive stopping sequence for stopping image formation at least by stopping the rotation of the developer carrier in the first direction when a prescribed number of printed sheets has been made before arriving at the threshold and the image formation is stopped, wherein said ordinary drive stopping sequence rotates the developer carrier in the second direction for a prescribed time period when the image formation is stopped and resumes the image formation after the prescribed time has elapsed, and wherein the number of printed sheets is reset when resuming the image formation.

4. The image forming apparatus as claimed in claim 3, wherein said image bearer is rotatable at multiple different line velocities, and wherein said threshold is changed in accordance with a line velocity.

5. An image forming apparatus operable in monochrome and full-color image formation modes, said image forming apparatus comprising:

at least two image bearers each configured to carry a latent image;

at least two developer carriers each configured to rotate in opposite first and second directions, said developer carrier carrying developer developing the latent image and obtaining a toner image only when said developer carrier rotates in the first direction;

at least two transfer devices each configured to transfer the toner image onto a recording medium;

a fixing device configured to fix the toner image onto the recording medium;

a sheet number threshold designating device configured to designate a prescribed number of sheets as a threshold per color mode;

a counter configured to count a number of printed sheets per color mode;

a controller configured to start an ordinary drive stopping sequence for stopping image formation at least by stopping the rotation of one of the at least two developer carriers in the first direction when said number of printed sheets reaches the threshold per color mode, wherein, in said ordinary drive stopping sequence, the controller rotates the one of the at least two developer carriers in the second direction for a prescribed time period when the image formation is stopped, and stops the rotation of the one of the at least two developer carriers in the second direction and resumes the image formation after the prescribed time has elapsed per color mode; and a setting device configured to invalidate the forced drive stop sequence per color mode.

6. The image forming apparatus as claimed in claim 5, wherein said number of printed sheets is reset per color mode when resuming the image formation.

7. An image forming apparatus operable in monochrome and full-color image formation modes, said image forming apparatus comprising:

at least two image bearers each configured to carry a latent image;

at least two developer carriers each configured to rotate in opposite first and second directions, said developer carrier carrying developer developing the latent image and obtaining a toner image only when said developer carrier rotates in the first direction;

at least two transfer devices each configured to transfer the toner image onto a recording medium;

a fixing device configured to fix the toner image onto the recording medium;

a sheet number threshold designating device configured to designate a prescribed number of sheets as a threshold per color mode;

a counter configured to count a number of printed sheets per color mode; and a controller configured to start an ordinary drive stopping sequence for stopping image formation at least by stopping the rotation of one of the at least two developer carriers in the first direction when said number of printed sheets reaches the threshold per color mode, wherein, in said ordinary drive stopping sequence, the controller rotates the one of the at least two developer carriers in the second direction for a prescribed time period when the image formation is stopped, and stops the rotation of the one of the at least two developer carriers in the second direction and resumes the image formation after the prescribed time has elapsed per color mode, wherein said controller starts said ordinary drive stopping sequence for stopping image formation at least by stopping the rotation of one of the at least two developer carriers in the first direction when a prescribed number of printed sheets has been made before arriving at the threshold and the image formation is stopped per color mode, wherein said ordinary drive stopping sequence rotates the one of the at least two developer carriers in the second direction for a prescribed time period when the image formation is stopped, and resumes the image formation after the prescribed time has elapsed, and wherein the number of printed sheets is reset per color mode when the image formation is resumed.

8. The image forming apparatus as claimed in claim 7, wherein said at least two image bearers are each rotatable at multiple different line velocities, and wherein said threshold is changed in accordance with a line velocity per color mode.

* * * * *